United States Patent [19]

Parton

[11] Patent Number: 4,463,747

[45] Date of Patent: Aug. 7, 1984

[54] FIREPLACE INSERT

[76] Inventor: James Parton, 300 E. 56th St., New York, N.Y. 10022

[21] Appl. No.: 356,238

[22] Filed: Mar. 8, 1982

Related U.S. Application Data

[63] Continuation-in-part of Ser. No. 285,769, Jul. 22, 1981, Pat. No. 4,411,251.

[51] Int. Cl.[3] ..... F23H 13/02

[52] U.S. Cl. ..... 126/164; 126/165; 126/298

[58] Field of Search ..... 126/164, 152 B, 165, 126/152 R, 152 A, 153, 203, 202, 201, 298; 211/60 R

[56] References Cited

U.S. PATENT DOCUMENTS

| | | | |
|---|---|---|---|
| 2,985,165 | 5/1961 | Peterson et al. | 126/165 |
| 3,505,986 | 4/1970 | Wood | 126/165 |
| 3,612,034 | 10/1971 | Wood | 126/165 |
| 3,838,679 | 10/1974 | Welch | 126/165 |
| 4,360,001 | 11/1982 | Thompson | 126/164 |

FOREIGN PATENT DOCUMENTS

| | | | |
|---|---|---|---|
| 0031859 | 1/1962 | Finland | 211/60.1 |
| 0016850 | of 1886 | United Kingdom | 126/201 |
| 0002507 | of 1886 | United Kingdom | 126/201 |
| 0001263 | of 1906 | United Kingdom | 126/153 |

*Primary Examiner*—James C. Yeung
*Assistant Examiner*—Helen A. Odar
*Attorney, Agent, or Firm*—Wilkie Stoll

[57] ABSTRACT

A fireplace insert comprising a frame having a plurality of arms pivotly mounted on the frame. The arms are adapted to move relative to each other in order to form an X-shaped configuration or a V-shaped configuration which will provide spaces to hold logs and/or kindling material. The arms are adjustable on the frame so that the spaces for the logs can be adjusted to accommodate logs of varying sizes. The device permits the logs to remain close to each other and at the same time will provide sufficient air space to form a very efficient fire.

5 Claims, 10 Drawing Figures

FIREPLACE INSERT

CROSS-REFERENCE

This is a continuation-in-part of pending U.S. patent application Ser. No. 285,769 filed on July 22, 1981 now U.S. Pat. No. 4,411,251.

DESCRIPTION OF THE INVENTION

The present invention is directed to an improved fireplace insert and more particularly to an improved fireplace insert which is adapted to permit a better fire to be built, which can accommodate a plurality of logs of varying sizes, as well as kindling, and which will be more efficient than existing fireplace inserts.

In view of current concerns about conserving energy, it is important to build efficient fires in fireplaces in order to obtain the maximum heat from wood-burning fireplaces.

The present invention has for one of its objects the provision of an improved fireplace insert in which the logs are in close proximity to each other.

Another object of the present invention is the provision of an improved fireplace insert in which the logs have adequate space therebetween to allow sufficient air to pass between them.

Another object of the present invention is the provision of an improved fireplace insert in which the space for the logs may be adjusted to accommodate logs of different sizes.

Another object of the present invention is the provision of an improved fireplace insert which has adequate room to receive kindling therein in close proximity to the logs.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein.

Figure 1:
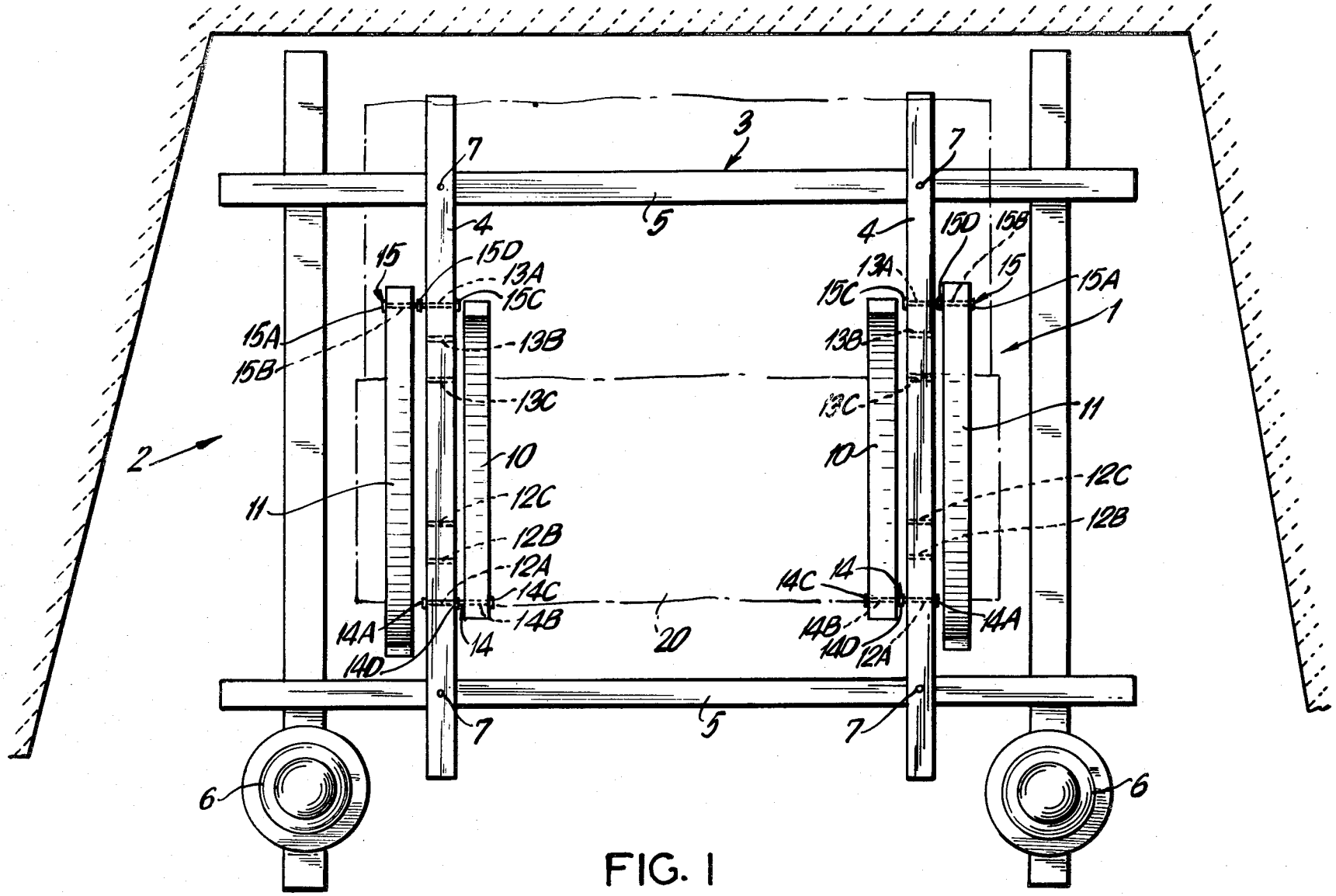
FIG. 1 is a top view of the fireplace insert of the present invention.
Figure 2:
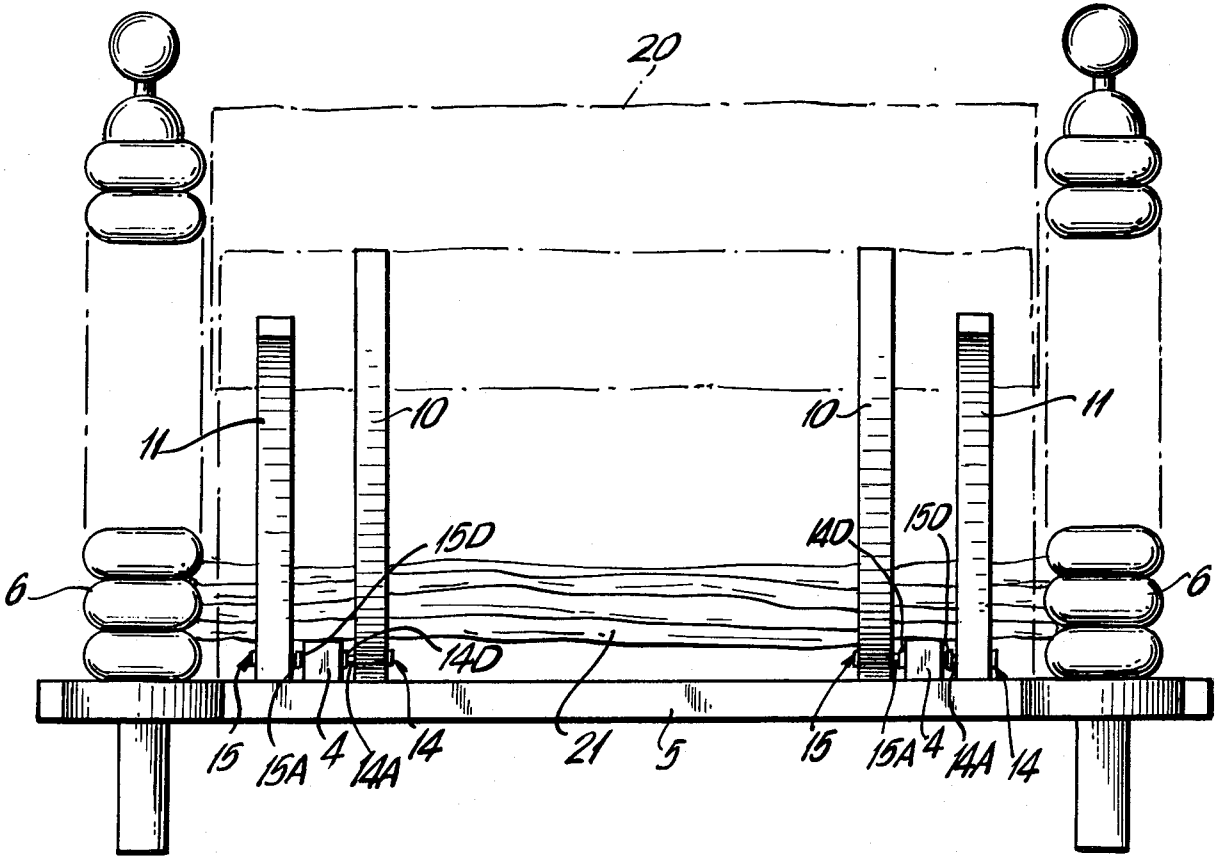
FIG. 2 is a front view thereof.
Figure 3:
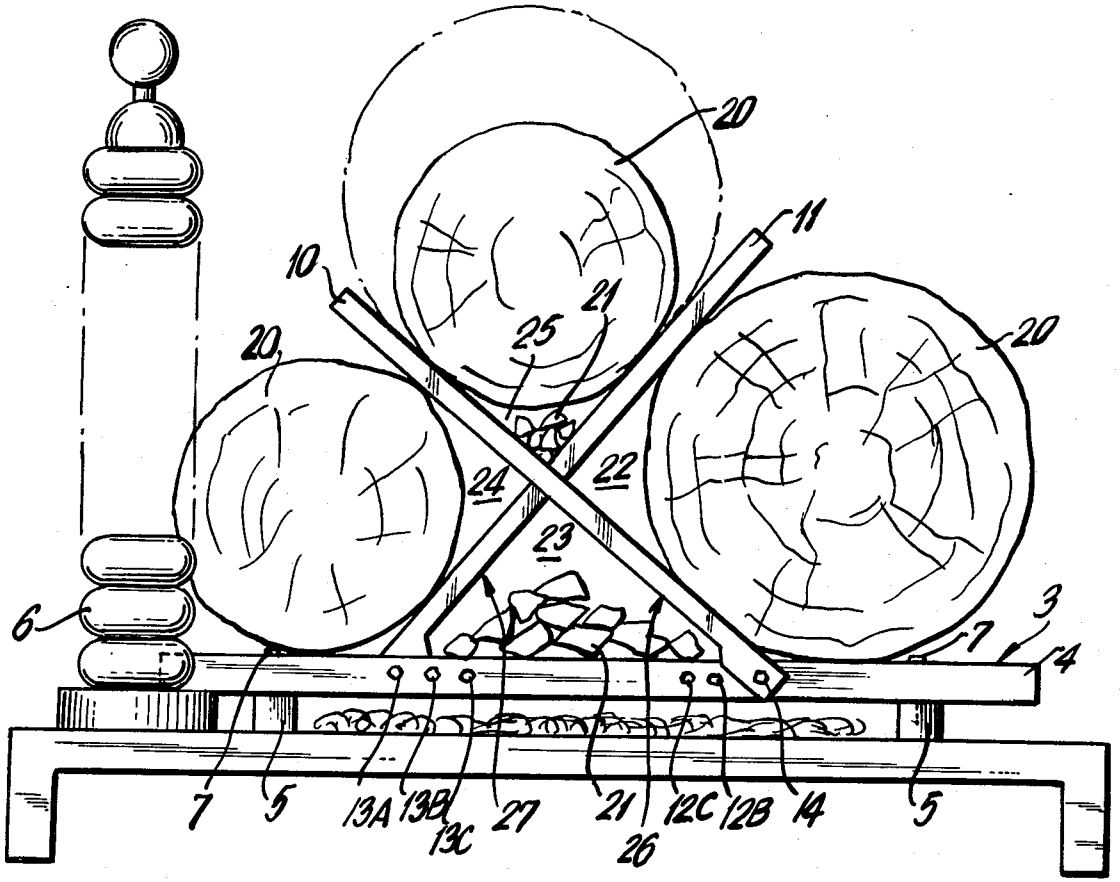
FIG. 3 is a side elevational view thereof.

Referring more particularly to the drawings and particularly FIGS. 1 to 3, the insert 1 of the present invention is adapted to be inserted within a fireplace enclosure 2 and comprises a frame 3 having a pair of substantially parallel side rods 4 and substantially parallel front and rear rods 5. The side, front and back members 4 and 5 are attached to each other by bolts 7 or in any other desired manner to form the generally square or rectangular frame 3. In the embodiment shown, the front and rear rods 5 are longer than the side rods 4 to permit the insert to rest on andirons 6 and be spaced above the fireplace floor. However, it will be understood that the front and rear rods 5 may be equal to the side rods 4, that a separate support may be provided for the frame 3 and that the andirons 6 may be incorporated as an integral part of the frame 3, if desired.

Each rod 4 is provided with a plurality of pivotally mounted log holding and separating front and rear arms 10 and 11, respectively. The front arms 10 are pivoted from the outer faces of the side bars 4 and the rear arms are pivoted from the inner faces of the side bars 4. However, this arrangement may be reversed, if desired. The arms 10 are pivoted in spaced openings 12A, 12B, 12C and the arms 11 are pivoted in spaced openings 13A, 13B, 13C, in the side rods 4 by means of a pivot pin assembly 14 and 15, respectively, extending from the arms 10 and 11. If desired, the pivot pin assembly 14 and 15 may comprise bolts 14A and 15A which extend through openings 14B and 15B in arms 10 and 11, respectively, and held in place by nuts 14C and 15C. Spacer washers 14D and 15D may also be used, if desired.

The front arm 10 will pivot backwardly and the rear arm 11 will pivot forwardly so that in their operative positions, the arms 10 and 11 form and X-shaped configuration as shown in FIG. 3 to form spaces 22, 23, 24 and 25. With the arms 10 and 11 in their operative X-shaped configuration, logs 20 and/or kindling 21 may be placed in the spaces 22, 23, 24 and 25. It will be noted that logs 20 usually vary in thickness; however, since the arms 10 and 11 are adapted to swing in any position, they will automatically adjust with relationship to each other and to the logs therein so as to accommodate themselves to the thicknesses of the logs 20 being used. The X-shaped configuration of arms 10 and 11 causes the logs 20 to be separated from each other so as to provide enough air space but at the same time positions the logs closer together to give a very efficient fire. If desired, kindling 21 may be placed in the lower space 23 in order to permit the fire to start quickly.

It will be noted that the arms 10 and 11 are each individually adjusted along the length of the side rods 4 by placing the bolts 14 and 15 in any of the bolt openings 13A to 13C as well as 12A to 12C. The arms 10 and 11 may be placed in different openings by removing the bolts 14 and 15 from one opening and inserting them into another opening so that the various spaces 22–25 may change in dimension to accommodate logs of different sizes.

In addition, the inside of the arms 10 and 11 may have elongated undercuts 26 and 27 therein in order to make the arms thinner. These undercuts 26 and 27 not only makes the arms 10 and 11 lighter, easier to handle, provide more space for the logs and/or kindling, but also permits the logs to be closer together to allow a more efficient fire to be made.

When in use, the arms 10 and 11 are moved to the X-shaped configuration and the kindling 21 is placed in the proper spaces, such as space 23. The arms are then adjusted to the necessary adjustment to accommodate the logs 20 which are placed in the spaces, such as spaces 22 to 25, formed by the X-shaped configuration of the arms 10 and 11. When the kindling 21 is ignited, the X-shaped configuration of the arms 10 and 11 provide sufficient air space between the logs 20 to permit sufficient air to flow between the logs 20 to give a very efficient fire.

Figure 4:
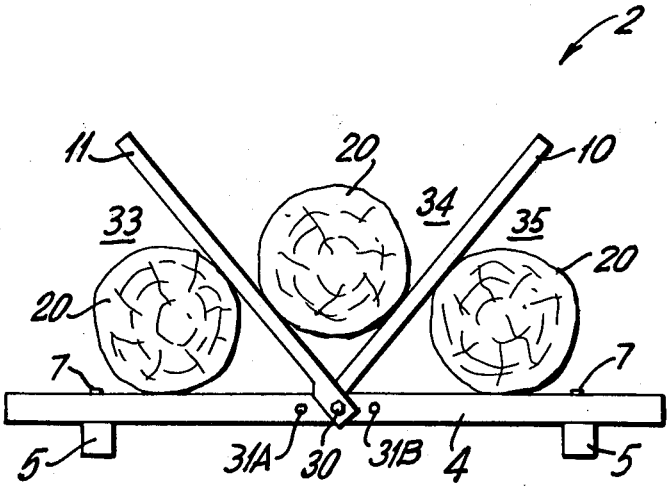
FIG. 4 is a side elevational view of a modification of the fireplace insert of the present invention.
Figure 5:
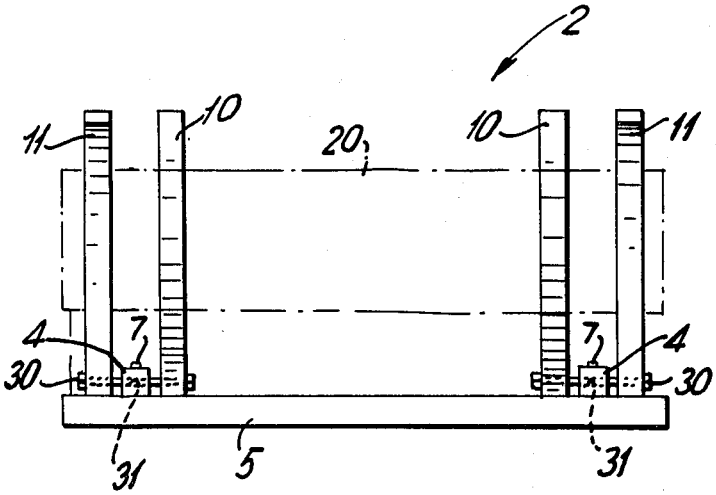
FIG. 5 is a front elevational view thereof.
Figure 6:
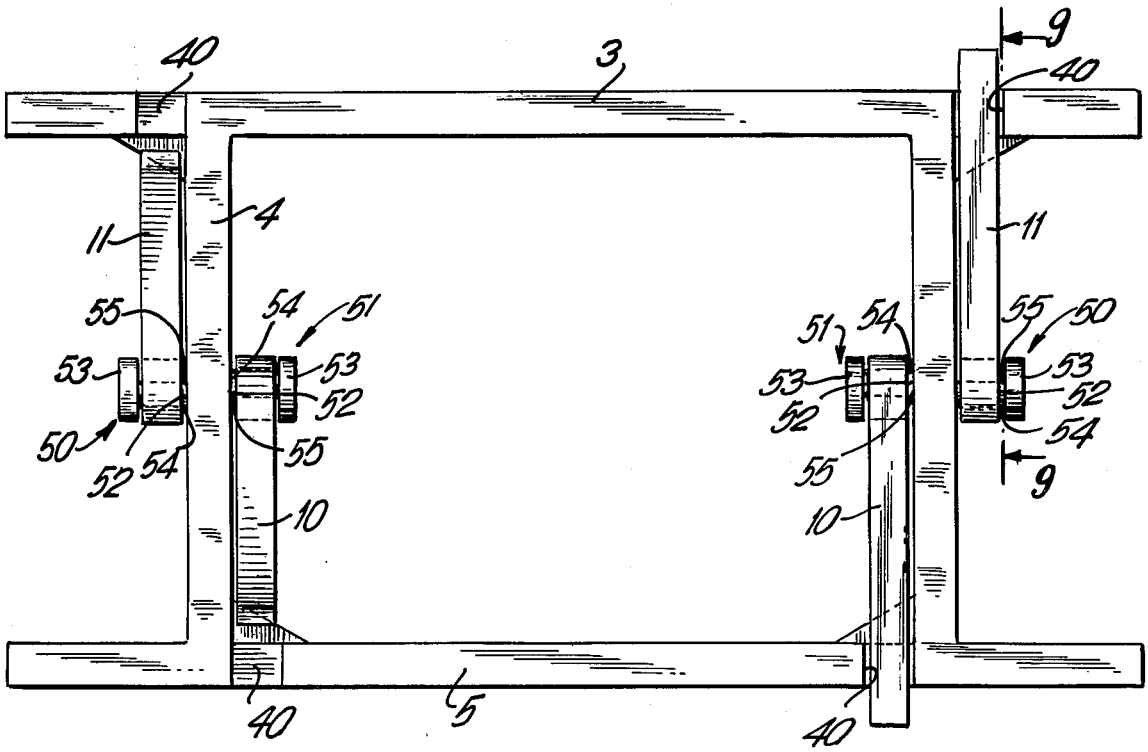
FIG. 6 is a plan view of another modification of the present invention.
Figure 7:
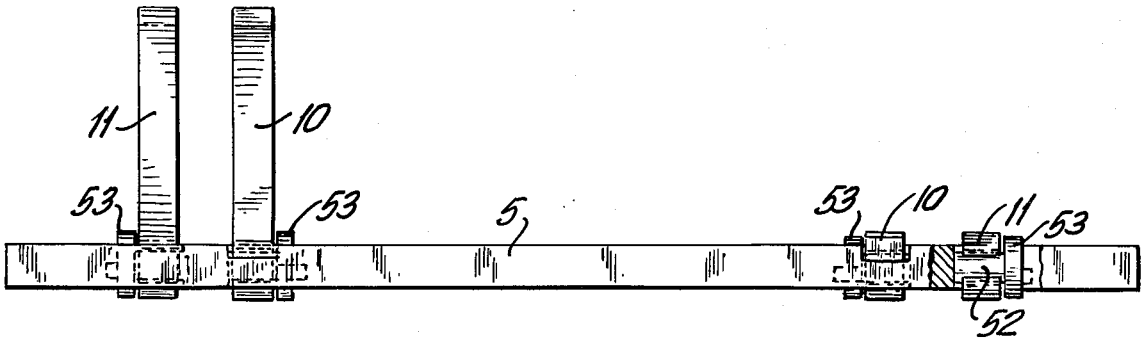
FIG. 7 is a front view thereof, partly in section.

Referring now to the modification in FIGS. 4 and 5, the arms 10 and 11 of the fireplace insert 2 are pivoted on a single pivot 30 on each side rod 4. Each pair of arms 10 and 11 are mounted on the single pivot 30 which extends through the opening 31 in side rods 4 and through the lower portions of the arms 10 and 11. Hence, the arms 10 and 11 pivot relative to each other around a common fulcrum to assume a V-shaped configuration rather than an X-shaped configuration assumed by the arms of the embodiment in FIGS. 1 to 3.

With this structure, the logs 20 may be mounted in the spaces 33, 34 and 35 which are formed by the arms 10 and 11 so that the logs 20 are in close proximity to each other and at the same time will be provided with sufficient air to form an efficient fire. If desired, additional openings 31A and 31B may be formed on either side of opening 31 in the side rods 4 so that the common fulcrum 30 of the two arms 10 and 11 may be adjusted relative to the side rods 4.

The use and operation of the fire insert shown and described in the embodiment of FIGS. 4 and 5 is the same as the use and operation of the fire insert shown and described in the embodiment of FIGS. 1 to 3 except that in the embodiment of FIGS. 4 and 5, the arms 10 and 11 assume a V-shaped configuration whereas in the embodiment of FIGS. 1 to 3, the arms 10 and 11 assume an X-shaped configuration.

In the embodiment shown in FIGS. 6 through 10, a single pivot pin 50 extends outwardly from each side member 4 to act as a pivot for each outer arm 11 and a single pin 51 extends inwardly from each side member 4 to act as a pivot for each inner arm 10. The two pins 50 and 51 are shown as being aligned with each other, however, they may be offset with respect to each other, if desired. If desired, notches 40 may be provided in end extension of the front and rear members 3 and 5 to receive arms 11 and 10.

The pivot pins 50 and 51 are similar to each other in construction and comprise a shank 52 and a head 53. Each shank 52 has a curved portion 54 and a flat portion 55. The distance between the flat portion 55 and the curved portion 56 is preferably a smaller distance than the diameter of the curved portion 54. Each arm 10 and 11 has a pivot opening 60 which opens into and communicates with a removal channel 61. The removal channel 61 is narrower than the diameter of the shank 52 of the pins 50 and 51 so that the arms 10 and 11 can pivot around the shanks 52. However, the removal channel 61 is wider than the distance between the flat portion 55 of the shank and the curved portion 54 so that when the arms 10 and 11 are in a particular position, they can be removed from the pivot pin 50. This configuration helps in the assembly of the fire insert since the arms 10 and 11 need merely be slipped onto the shanks 52 and rotated to have the arms mounted thereon. The arms 10 and 11 may also be easily disassembled during shipment to reduce the size of the shipping carton.

In assembling the device, the arms 10 and 11 are mounted on the pivot pins 51 and 50 by positioning the removal channel 61 over the shanks 52 so that the removal channel 61 is able to move over the shanks 52. The arms 10 and 11 are then pivoted so that the removal channel 61 is placed adjacent the curved portion 54 of the shank 52 to lock the arms in place. When it is desired to remove the arms 10 and 11, the arms are positioned so that the access channels 61 are in line with the flattened portions 55 to permit the arms to be slipped off the shanks 52 and removed.

Figure 8:
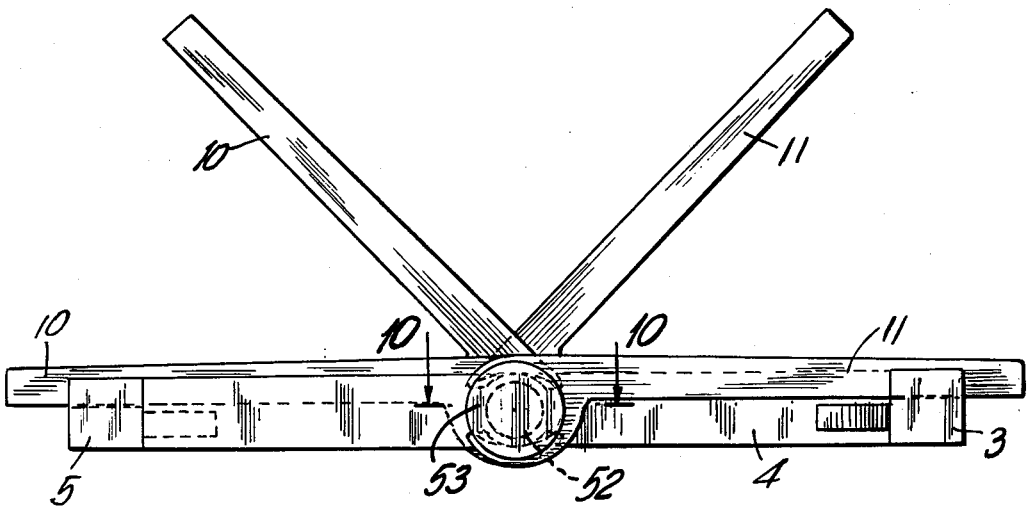
FIG. 8 is a side view thereof.
Figure 9:
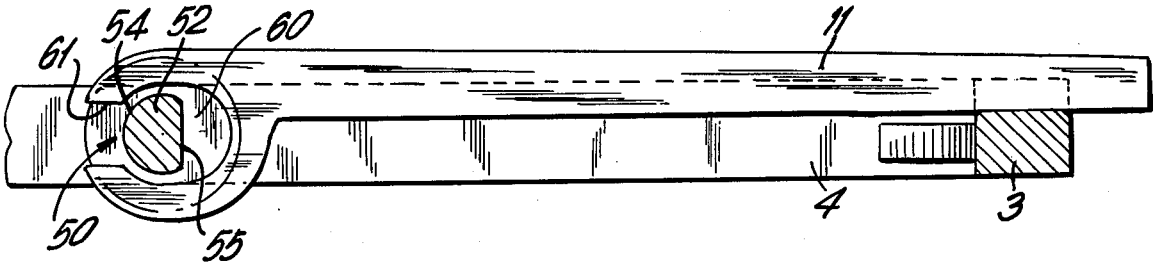
FIG. 9 is a sectional view taken along line 9—9 of FIG. 6.
Figure 10:
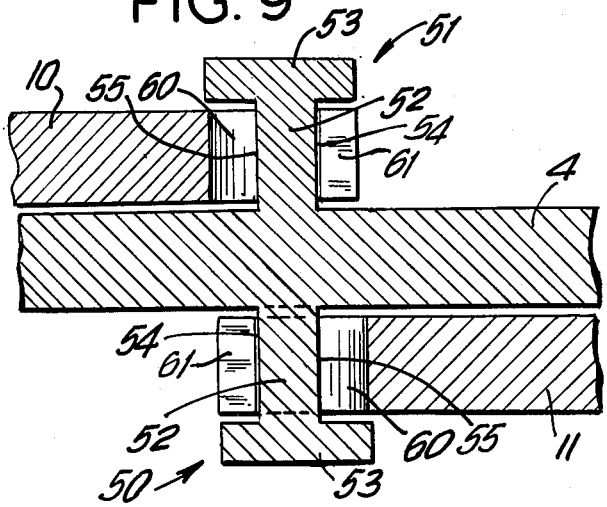
FIG. 10 is a sectional view taken along line 10—10 of FIG. 8.

Pins 50 on opposite faces of the side members 4 have their flat portions 55 and their curved portions 54 facing in opposite directions so that the arms 10 and 11 are held in place facing in opposite directions to maintain the configuration shown in FIG. 8.

It will thus be seen that the present invention provides an improved fireplace insert in which the logs are in proximity to each other while providing sufficient space for air to pass therebetween, in which the space for the logs may be adjusted to accommodate logs of different sizes and in which there is adequate room for kindling to be inserted therein in close proximity to the logs and which produces a very efficient fire.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A metal fireplace insert comprising a frame, a plurality of arms pivotly mounted on said frame, each of said arms being pivoted for independent movement relative to each other and to the frame to form a plurality of log-receiving spaces, said frame comprises a pair of side bars and front and rear bars mounted to said side bars, said side bars being located adjacent the opposite edges of the front and rear bars, said arms being pivotly mounted on said side bars, each of said side bars having a front and rear arm pivotly mounted thereon, the front and rear arms pivotly mounted on one side bar being independently movable from the front and rear arms of the other side bar, said front and rear arms being pivoted for independent movement on opposite sides of each of said side bars, said front and rear arms being pivoted relative to each other to form a V-shaped configuration, each of said front and rear arms being pivoted on a common pivot on each side bar, said pivot comprises a shank and an outer head, said shank having a portion of greater length and portion of lesser length, each of said arms having a pivot opening and a removal channel communicating therewith, the width of said removal channel being less than the shank portion of greater length and greater than the shank portion of lesser length.

2. A fireplace insert as claimed in claim 1 wherein the said shank has a circular portion and a flattened portion and the portion of greater length is the diameter thereof and the portion of lesser length is the distance between the circumference and the flattened portion.

3. A fireplace insert as claimed in claim 2 wherein said flattened portion is a cord having a length less than the diameter of the shank.

4. A fireplace insert as claimed in claim 3 wherein said pivots extend from opposite sides of the side members of the insert and have their flat portions facing in opposite directions.

5. A fireplace insert as claimed in claim 4 wherein the heads of the pivots are rounded.

* * * * *